US005344481A

United States Patent [19]

Pettersson

[11] Patent Number: 5,344,481

[45] Date of Patent: Sep. 6, 1994

[54] SUSPENSION DEVICE AND RAPPING MECHANISM FOR ELECTRODES IN AN ELECTROSTATIC PRECIPITATOR

[75] Inventor: Vagn A. Pettersson, Valby, Denmark

[73] Assignee: FLS Miljo A/S, Denmark

[21] Appl. No.: 112,690

[22] Filed: Aug. 26, 1993

[30] Foreign Application Priority Data

Aug. 28, 1992 [DK] Denmark ..... 1077/92

[51] Int. Cl.[5] ..... B03C 3/76

[52] U.S. Cl. ..... 96/33; 96/83; 96/92

[58] Field of Search ..... 96/32,33, 37, 38, 83, 96/86, 87, 92, 93; 95/74, 76

[56] References Cited

U.S. PATENT DOCUMENTS

| | | | |
|---|---|---|---|
| 3,435,594 | 4/1969 | Steuernagel | 96/33 |
| 3,729,815 | 5/1973 | Quintilian et al. | 96/87 X |
| 4,221,573 | 9/1980 | Hankins | 96/35 |
| 4,671,808 | 6/1987 | Goransson | 96/38 |

FOREIGN PATENT DOCUMENTS

| | | |
|---|---|---|
| 224799 | 2/1969 | Sweden . |
| 2180172 | 3/1987 | United Kingdom . |

*Primary Examiner*—Richard L. Chiesa

*Attorney, Agent, or Firm*—Brumbaugh, Graves, Donohue & Raymond

[57] ABSTRACT

In an assembly incorporating a suspension device and a rapping mechanism for vertically mounted electrodes of a high-voltage supplied electrostatic precipitator, discharge electrodes (9) are suspended from horizontal frame tubes (8'), which are in turn connected to vertical frame tubes (5) having an upper, rod-shaped portion (12). The portion (12) of each of the frame tubes (5) is mounted in vertically aligned holes (14) in the legs of U-shaped support irons (4) attached to the carrier beams (1), which are in turn suspended from the roof of the precipitator housing via carrier rods (3). The upward facing end surface of the portion (12) serves as an abutment for a drop hammer (13) which causes rapping of the electrodes.

4 Claims, 3 Drawing Sheets

SUSPENSION DEVICE AND RAPPING MECHANISM FOR ELECTRODES IN AN ELECTROSTATIC PRECIPITATOR

BACKGROUND OF THE INVENTION

The invention relates to a suspension device and a rapping mechanism for vertically mounted electrodes, preferably rod-shaped, tubular, helical or plate electrodes in a high-voltage supplied electrostatic precipitator for the cleaning of smoke gases from the combustion of fossil fuels, waste material and the like in industrial plants, such as for instance power supply plants, combustion plants, cement plants and the like.

During filtration of smoke gases in such electrostatic precipitator an electrical high-voltage field is established between the collecting and discharge electrodes of the precipitator, in which field an ionisation of the dust particles passing through the precipitator occurs. Some of the particles charged thereby travel towards the collecting electrodes and the oppositely charged particles travel towards the discharge electrodes due to the corresponding opposite polarity in the relevant electrodes and there they accumulate, thus necessitating periodical vibration or rapping of the electrodes to remove the accumulated particles.

The discharge electrodes are metal electrodes and generally rod-shaped, tubular or plate electrodes or consist of wire helices and are suspended between a conductive top and a conductive bottom frame which may be connected by means of a vertical frame construction which is also conductive. The aggregate frame construction, together with a corresponding frame construction for the collecting electrodes which are generally plate electrodes, in the precipitator is surrounded by a precipitator housing to which the frame constructions are secured. The rod-shaped, tubular or plate discharge electrodes may be provided with a number of rod- or bow-shaped protrusions over their entire length to increase the corona discharges and thus to increase the precipitator effect when the precipitator is in use. In the hitherto known electrostatic precipitator types, e.g. SE patent No. 224,799, the frame is constituted by a comparatively heavy construction in order to support the suspended electrodes. The frame is suspended by means of vertical rods in insulators which are mounted in or on the precipitator housing roof, and may furthermore be connected to the supporting construction of the housing by means of inserted insulators and helical, plate or leaf spring mechanisms in order to limit the transfer of rapping or vibration energy from the electrodes to the housing and the insulators.

A bottom frame may, in addition to securing the electrodes at their lower ends, serve to maintain a convenient spacing between the discharge electrodes and the collecting electrodes to prevent the discharge electrodes from oscillating towards the collecting electrodes, thereby releasing a spark discharge. Such spark discharge temporarily reduces the electrical energy in the electrode spacings and impairs the precipitator efficiency. Often, the known precipitator constructions have the disadvantage that due to the comparatively excessive length of the electrodes the bottom frame oscillates back and forth relative to a top frame, thereby increasing the risk of sparkover between the electrodes.

The rapping mechanism for discharge electrodes in the known precipitators usually comprises electrically or pneumatically operated impact means, e.g. drop hammers, which are caused to rotate about a horizontal axis mounted above the precipitator housing, or weights on a crankshaft mounted horizontally in the same place. The impact means is brought by their rotation to abut anvils which are, in a number corresponding to the number of hammers or weights, secured to the top frame. Thus the top frame will absorb a portion of the impact energy produced which will, instead of being transferred in its entirety to the electrodes, partly be transmitted to the precipitator housing construction irrespective of any damping means optionally inserted between the latter and the frame.

It is therefore the object of the present invention to provide an assembly of a suspension device and a rapping mechanism for electrodes in an electrostatic precipitator, in particular the discharge electrodes of such precipitator, which remedies the above-mentioned disadvantages of the hitherto known precipitators.

SUMMARY OF THE INVENTION

This object is achieved by means of a suspension device and a rapping device for electrodes of an electrostatic precipitator having vertically mounted support tubes from which the electrodes are suspended. The vertically mounted support or frame tubes of the precipitator have corona discharge points and serve as discharge electrodes. Top portion of each of the support tubes is suspended from and; vertically movable in U-shaped supporting irons with horizontally extending flanges or legs arranged vertically above each other. The vertical support or frame tubes form at their upper ends solid rods which like anvils serve as abutments for drop hammers so that approximately all impact energy from the drop hammers is transferred to the support or frame tubes and hence to the precipitator electrodes instead of, like in the hitherto known precipitator constructions, being largely transferred to the precipitator housing proper.

BRIEF DESCRIPTION OF THE DRAWINGS

The invention will be described more in detail in the following with reference to the drawing which is an example and a non-limiting illustration of embodiments of the invention, and wherein.

DESCRIPTION OF THE PREFERRED EMBODIMENTS

Figure 2:
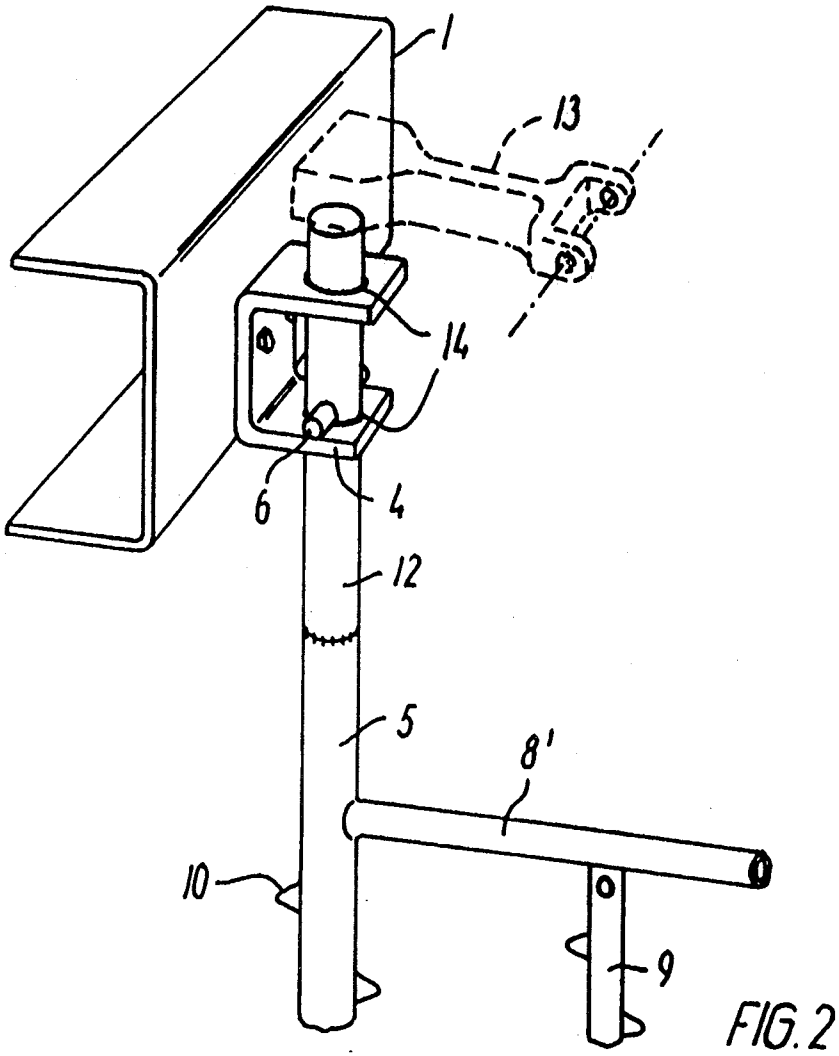
FIG. 2 is a blow-up of a detail of FIG. 1.
Figure 1:
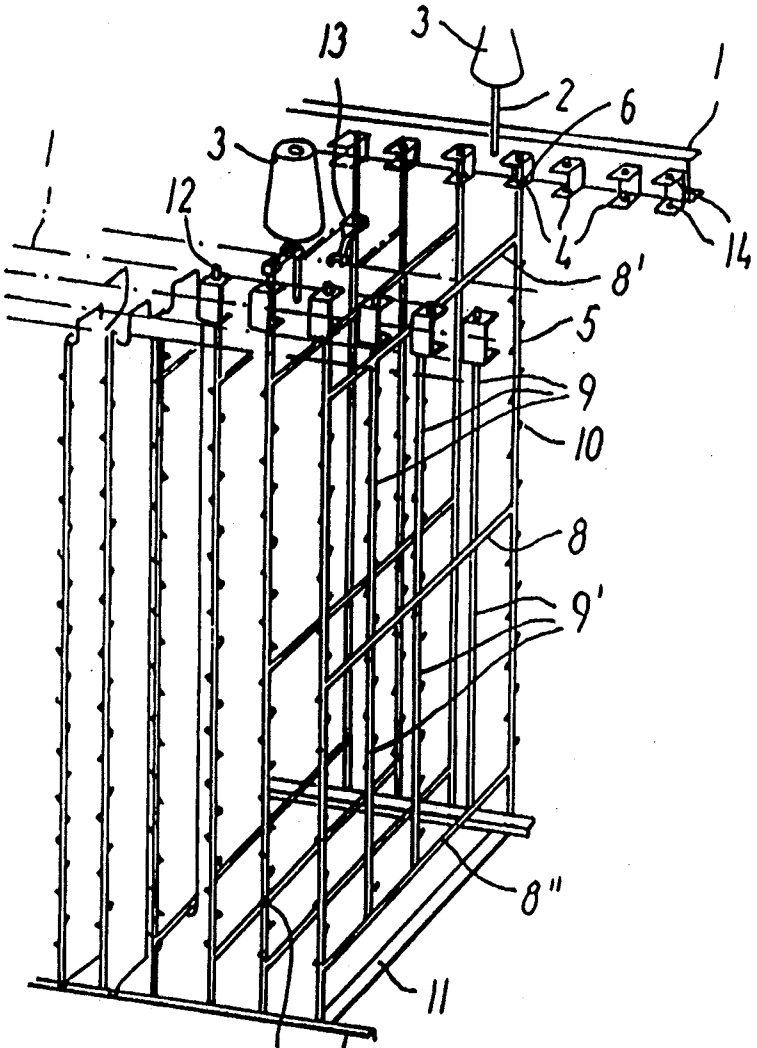
FIG. 1 is a perspective view of a section of the discharge electrodes of an electrostatic precipitator and the suspension device thereof.
Figure 3:
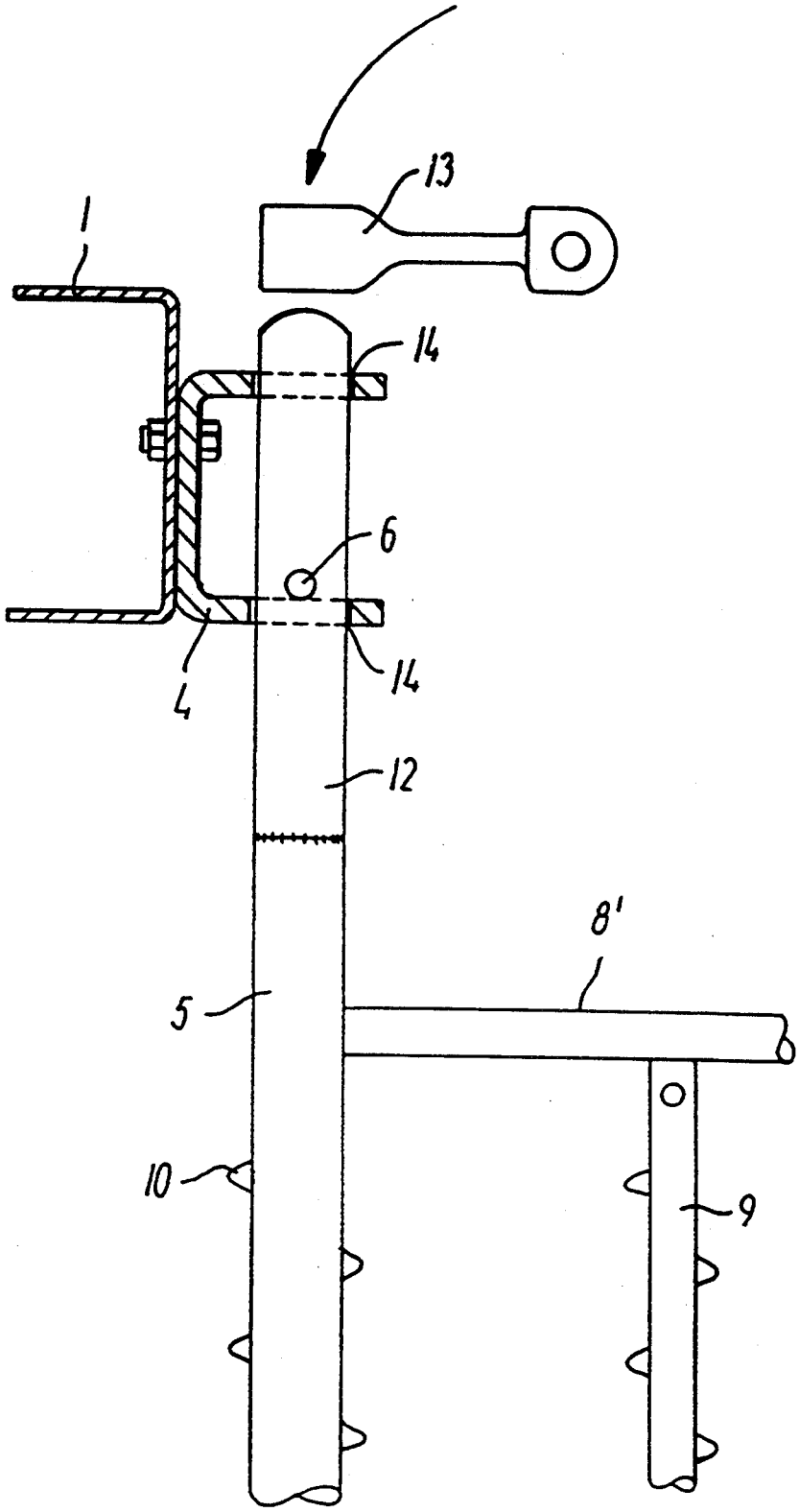
FIG. 3 is a partial sectional sideview of FIG. 2.

In FIG. 1, 2 and 3, I denotes a U-shaped or angular support or carrier beam mounted horizontally at the top of the precipitator housing. The beam is suspended in insulators 3 by vertical rods 2, said insulators being secured in or on the precipitator housing roof (not shown). On the beam surface facing the housing interior a number of U-shaped support irons 4 are secured which in each leg have mutually axially located holes 14 wherein vertical metal frame tubes 5 are suspended by means of a locking pin 6. The vertical frame tubes 5 formed as electrodes with corona discharge bows or protrusions 10 are at their uppermost ends constituted by massive rods 12, the upwardly facing end surfaces of which act as anvils for an impact means 13, shown in the figures as a drop hammer; which rotates about a not shown horizontal axis.

The vertical frame tubes 5 for each precipitator section are mutually connected at their upper and lower ends by horizontal frame tubes 8' and 8'', respectively, and, optionally, by at least one additional transversal frame tube 8 so that the precipitator section frame in the shown embodiment is divided into two or more smaller frames wherein the remaining discharge electrodes 9, 9' are mounted.

In order to obtain maximum torsional rigidity of the construction the vertical frame tubes 5 may furthermore be connected at their lower ends by means of transversal frame beams 7 which in turn may be connected by cross-braces 11 or diagonal braces.

During rapping or vibration of the electrodes a rod 12 is hit at its upwardly facing end surface by the drop hammer 13, as shown in FIG. 3. The impact produces a downwardly oriented compression wave in the rod 12 and thus in the tube 5. The rod 12 and the tube 5 are suspended in the support iron 4 by means of the locking pin 6 and the support iron makes therefore a resilient movement at the abutment allowing almost unimpeded transfer of the compression wave downwards to the electrodes thus imparting to the latter a rapping or vibrating movement. The transversal frame tubes 8', 8 and 8'' secured to the tubes 5 follow the vibrating movement, and along with the frame tubes also the; electrodes 9 and 9'.

Figure 4:
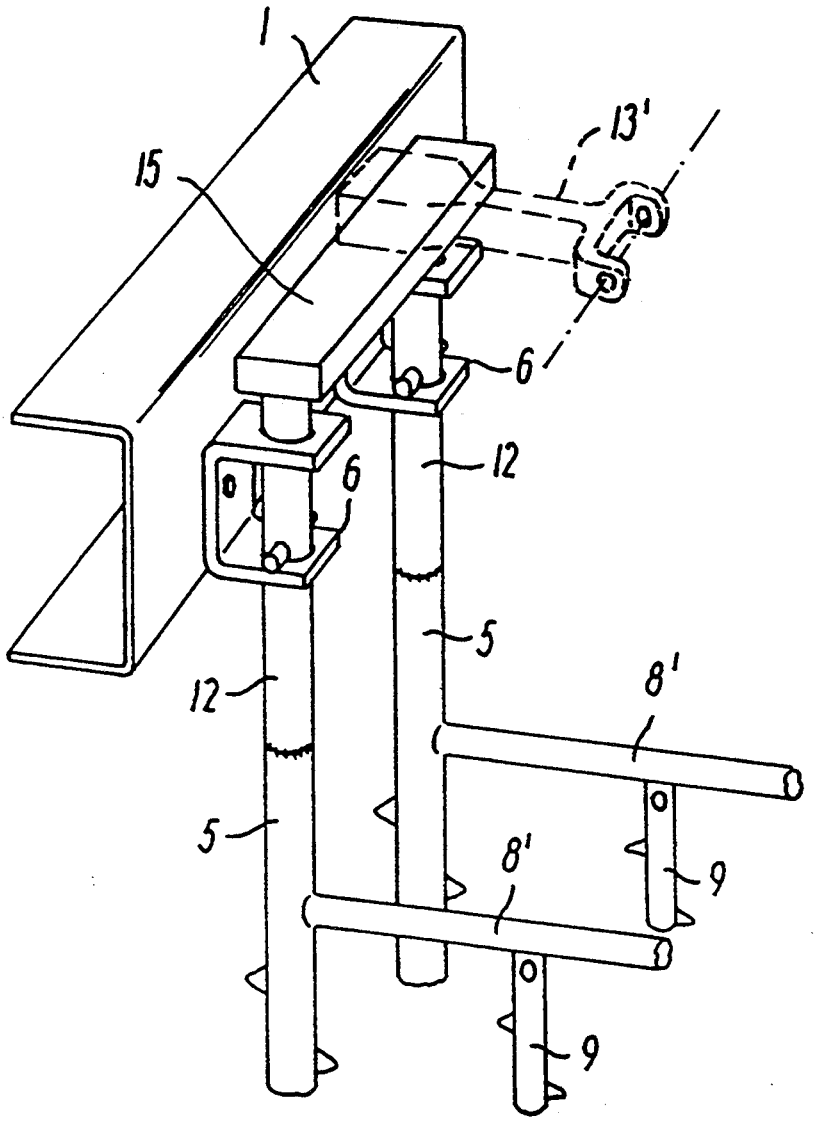
FIG. 4 is a perspective view of a detail of FIG. 1 wherein two rows of electrodes are served by one and the same impact means.

In precipitators where only moderate rapping is required at least two upwards facing end surfaces of the frame tubes 5 of two adjacent precipitator sections may be connected by one and the same anvil 15, as shown in FIG. 4. This construction requires only a limited number of impact means corresponding to the number of anvils.

The suspension device and the rapping mechanism according to the invention for the discharge electrodes of an electrostatic precipitator represent among other things the following advantages:

The suspension of the vertical frame tubes 5 in the U-shaped support irons 4 constitutes a torsionally rigid joining which contributes substantially to an increased overall rigidity of the frame construction.

The division of the individual precipitator section frame into two or more smaller frames provides a substantially improved cross-rigidity of the aggregate frame construction.

Calculations and full-scale measurements have shown that the frame system according to the invention is so rigid that the use of conventional oscillation damping insulators at the lower portion of an electrostatic precipitator may be avoided, The frame portions and the electrodes may be designed so as to be of limited length thereby facilitating their packaging and transportation from manufacturer to site of use, and likewise allowing separate assembly of the individual precipitator section frame and subsequently mounting it in its final position in a precipitator housing.

Due to the resilient suspension of the electrodes in the support irons 4 the amount of impact energy transferred to the support insulators of the discharge system is reduced.

I claim:

1. A suspension device and rapping mechanism for vertically mounted electrodes (5,9), in a high-voltage supplied electrostatic precipitator, and wherein a conductive suspension device comprises at least two U-shaped or angular carrier beams (1) arranged perpendicularly to the precipitator sections or the electrode rows and above and near their upper ends, said carrier beams being suspended in vertical carrier rods (2) which at their upper ends are secured in insulators (3) in the roof of a precipitator housing, the rapping mechanism comprising means (13) mounted on or near the precipitator housing roof in order to produce a vertically acting impact energy towards the upwardly facing ends of the electrodes (5,9) thereby rapping or vibrating the latter, and vertical support or frame tubes comprising some of said electrodes (5) of each precipitator section being mutually connected by at least one upper and a lower horizontal frame tube (8',8'') to form vertical frames for the electrode rows, and the remaining vertically mounted electrodes (9,9') of a precipitator section being arranged between the horizontal frame tubes (8',8''), wherein a number of U-shaped support irons (4) are secured on the sides of the carrier beams (1) facing the electrode rows and mounted so that the horizontally extending legs of the U in said U-shaped support irons are located vertically above each other, the vertical precipitator support or frame tubes comprising some of said electrodes (5) of each precipitator section or electrode row being suspended in said legs, that the upper portion of the vertical support or frame tubes comprising some of said electrodes (5) are formed as a solid rod (12), vertically movably secured in the individual U-shaped support iron (4) and with its upwardly facing end comprising an abutment or an anvil for the impact means (13) of the rapping mechanism, and that the U-shaped support irons (4) have holes (14) in the legs of the U in said U-shaped support irons being arranged vertically above each other for receiving the rod-shaped upper portion (12) of the vertical support or frame tubes so that the suspension of the tubes in the support irons are partly vertically resilient and partly torsionally rigid.

2. A suspension device and rapping mechanism according to claim 1, wherein the rod-shaped portion (12) near its upper end has a hole for a transversal locking pin (6) which upon mounting of the tube in the precipitator housing secures the rod-shaped portion (12) in the U-shaped support iron (4) in such a way that the pin (6) abuts the upwardly facing surface of the lowermost U-leg in said U-shaped support iron causing the rod-shaped portion (12), the tube comprising one of said electrodes (5), and the horizontal frame tubes (8,8' and 8'') secured to the electrode (5) to carry out an upward and a downward movement through the impact from the impact means whereby the rapping or vibration of the electrodes is effected.

3. A suspension and rapping mechanism according to either of claims 1 or 2, wherein two or more vertical support or frame tubes comprising some of said electrodes (5) are mutually connected at the upwardly facing end surfaces of their rod-shaped portions (12) by a common abutment or a common anvil (15) which, when hit by the impact means (13) of the mechanism, concurrently transfers impact energy to the rod-shaped portions (12) and tubes comprising some of said electrodes (5) connected to said anvil of two or more adjacent precipitator sections or electrode rows.

4. A suspension device and rapping mechanism according to claim 1, wherein said vertically mounted electrodes comprise a discharge electrode having a selected one of rod, tubular, helical and plate shapes.

* * * * *